United States Patent [19]

Grau et al.

[11] Patent Number: 4,951,357

[45] Date of Patent: Aug. 28, 1990

[54] STOP MOTION APPARATUS FOR A ROVING DRAFTING DEVICE OF A TEXTILE MACHINE

[75] Inventors: Gerhard Grau, Muellheim; Manfred Lattner, Ebersbach/Sulpach; Helmut Nickolay, Uhingen, all of Fed. Rep. of Germany

[73] Assignee: Zinser Textilmaschinen GmbH, Fed. Rep. of Germany

[21] Appl. No.: 400,987

[22] Filed: Aug. 31, 1989

[30] Foreign Application Priority Data

Sep. 3, 1988 [DE] Fed. Rep. of Germany ..... 3830069
Jan. 31, 1989 [DE] Fed. Rep. of Germany ..... 3902715

[51] Int. Cl.[5] ..... D01G 31/00; D01H 13/18
[52] U.S. Cl. ..... 19/0.25; 57/84
[58] Field of Search ..... 19/0.25, 244, 258, 288; 57/84, 86, 87

[56] References Cited

U.S. PATENT DOCUMENTS 3,807,161 4/1974 Ingham, Jr. ..... 57/84
4,480,354 11/1984 Glock et al. ..... 19/0.25
4,484,376 11/1984 Glock et al. ..... 19/0.25
4,727,713 3/1988 König et al. ..... 57/84

FOREIGN PATENT DOCUMENTS 3406397 2/1984 Fed. Rep. of Germany .
3536913 10/1985 Fed. Rep. of Germany .

*Primary Examiner*—Werner H. Schroeder
*Assistant Examiner*—John J. Calvert
*Attorney, Agent, or Firm*—Shefte, Pinckney & Sawyer

[57] ABSTRACT

A stop motion apparatus for a drafting device for roving in a textile machine includes a stop member into roving stopping engagement with the intake feed rollers of the drafting device by operation of an actuating rod. The actuating rod includes a notch having an undercut surface for engagement by a plunger element. Preferably, the undercut surface is transversely arcuate and the plunger element includes a plastic sleeve element compatibly configured with the actuating rod notch. the plunger element is selectively insertable into, and retractable from, the notch of the operating rod by an electromagentic assembly operatively connected to a yarn break monitor. The stop motion apparatus includes a shaft having a forked end for manually clearing the plunger element from the actuating rod notch.

16 Claims, 3 Drawing Sheets

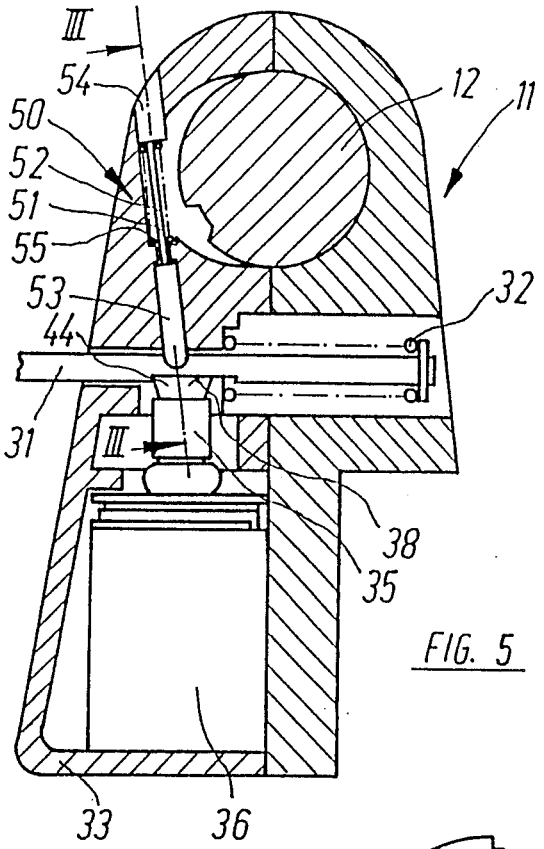
FIG. 5
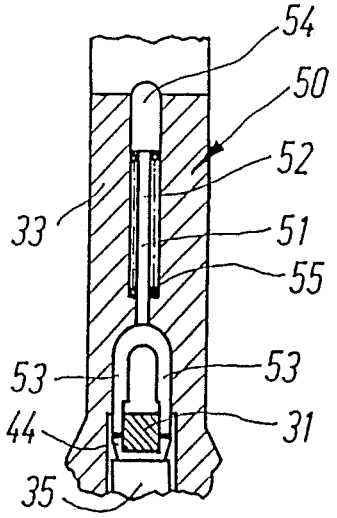
FIG. 6
FIG. 7
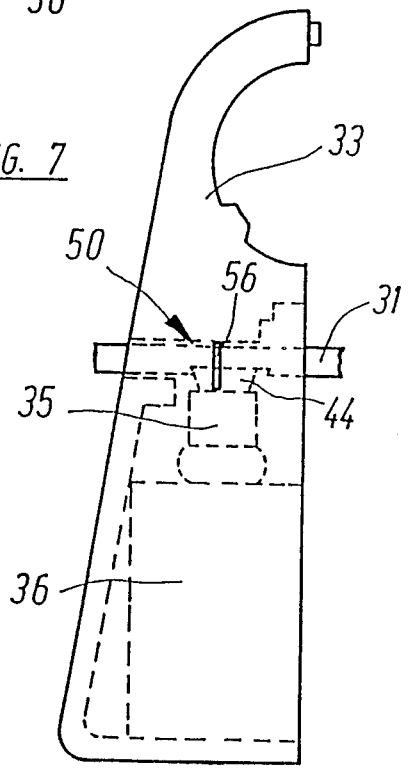
FIG. 8
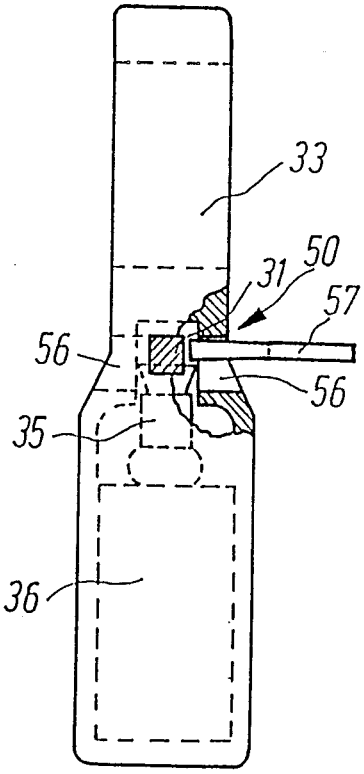

STOP MOTION APPARATUS FOR A ROVING DRAFTING DEVICE OF A TEXTILE MACHINE

BACKGROUND OF THE INVENTION

The present invention relates to a stop motion apparatus for stopping the travel of roving through a roving drafting device of a textile machine.

Typically, roving drafting devices have several related pairs of roving feed rollers with roving fed between the nips defined between each related pair of feed rollers. To stop the travel of roving through the roving drafting device, it is known to provide a stop member for selective insertion into one of the nips between the pair of roving feed rollers to thereby separate the pair of roving feed rollers and press the roving against one of the feed rollers to stop its travel.

To actuate the stop member, the machine typically includes an actuating rod to which the stop member is movably connected. The actuating rod is longitudinally movable to effect insertion and retraction of the stop member from the nip between the pair of roving feed rollers. Typically, the actuating rod is continuously urged by a spring toward its position for effecting insertion of the stop member into the nip. However, the actuating rod is provided with a notch which is engaged by a selectively retractable plunger element and the notch and the selectively retractable plunger element are positioned relative to one another to maintain the actuating rod in its position in which it holds the stop member out of engagement with the nip.

In German Patentsschrift 34 06 397, and electromagnetic assembly is disclosed for controlling the retraction and insertion of a plunger element into a notch of an actuating rod. The electromagnetic assembly is, for example, responsive to a signal transmitted by a yarn monitor which monitors the travel of the roving for interruptions thereat. Once an interruption in the travel of the roving is sensed, the electromagnetic assembly is actuated to retract the plunger element from the actuating rod notch, whereupon the spring engaging the actuating rod automatically moves the actuating rod into the position in which the stop member is inserted into the nip between the roving feed rollers. However, the need exists for improvement in the wear characteristics of the actuating rod and plunger element assemblies described above. Specifically, the relatively frequent insertion and retraction of the plunger element from the notch of the actuating rod eventually tends to cause wear of the surfaces of the notch contacted by the plunger element. As wear of the notch surface increases, the risk that the plunger element will not reliably engage the notch also increases.

SUMMARY OF THE INVENTION

The present invention provides a stop motion apparatus which enhances the capability of the plunger element to reliably engage the notch of the actuating rod.

Briefly described, the present invention provides a stop motion apparatus for stopping the travel of roving through a nip definded by a pair of roving feed rollers of the roving drafting device of a textile machine. The stop motion apparatus includes a stop member of selective insertion into the nip to separate the roving feed rollers and press the roving against one of the feed rollers, an actuating rod, a frame movably supporting the actuating rod, means connecting the stop member to the actuating rod, urging means, notch engaging means including a plunger element and means for selectively moving the plunger element. The urging means urges the actuating rod from a disengaged position in which the stop member is held out of engagement with the roving feed rollers by the means connecting the stop member of the actuating rod to an engaged position in which the stop member is disposed in the nip between the roving feed rollers. The actuating rod has a notch formed therein, the notch opening transversely to the longitudinal extent of the rod and having an undercut surface facing in the direction of urging by the urging means. The plunger element is configured for receipt in the actuating rod notch against the undercut surface in the disengaged position of the actuating rod to prevent movement of the actuating rod from its disengaged to its engaged position by the urging means. The notch of the actuating rod acts to effectively and reliably properly position the plunger element to thereby minimize wear on the rod due to improper positioning of the plunger element.

To further enhance wear characteristics and proper seating of the plunger in the notch, the undercut notch surface is, preferably, transversely arcuate and is arcuately concave and the plunger element is formed with an arcuately convex shape compatibly configured with the arcuately concave undercut notch surface. Also preferably, the actuating rod notch includes another undercut surface facing in the direction opposite the urging by the urging means. The other undercut surface extends generally transversely to the longitudinal extent of the actuating rod. In the preferred embodiment, the undercut notch of the actuating rod is in the form of a dovetail.

Also in the preferred embodiment, the plunger element includes a body portion, an end portion formed on the body portion and a sleeve portion, the end portion being of less cross-sectional area than the body portion and the sleeve portion being mounted on the end portion for engagement in the nothc of the actuating rod. The sleeve portion preferably includes an annular inner surface and a frusto conical exterior surface tapering in the direction of the body portion. Preferably, the sleeve portion is formed of plastic.

Preferably, the plunger element is movably axially supported in a solenoid for movement into, and retraction from, the actuating rod notch, and the stop motion apparatus includes an annular resilient sealing ring supported in the solenoid, and the plunger element includes an annular groove, the annular resilient sealing ring selectively encircling the annular groove of the plunger element when the plunger element is retracted from the actuated rod notch.

The stop motion apparatus of the present invention preferably includes means for manually clearing the plunger element from the notch and the plunger element extends laterally beyond the actuating rod for engagement during manual clearing of the apparatus. In one form, the manual clearing means includes a shaft member having a forked end mounted in the frame for axial movement toward the plunger element and a spring for biasing the shaft member away from the plunger element, the shaft member forked end being configured for straddling the actuating rod to engage the plunger element extending laterally beyond the actuating rod. In another form, the manual clearing means includes an opening formed in the frame for permitting access to the plunger element.

BRIEF DESCRIPTION OF THE DRAWINGS

FIG. 5 is an enlarged transverse vertical sectional view of the stop motion apparatus shown in FIG. 1;

FIG. 6 is a vertical sectional view of the stop motion apparatus of FIG. 5 taken along l ines III—III thereof;

FIG. 7 is a side elevational view of a portion of a variation of the stop motion apparatus of FIG. 1; and FIG. 8 is a front elevational view, in partial section, of the stop motion device shown in FIG. 7.

DETAILED DESCRIPTION OF THE PREFERRED EMBODIMENTS

Figure 1:
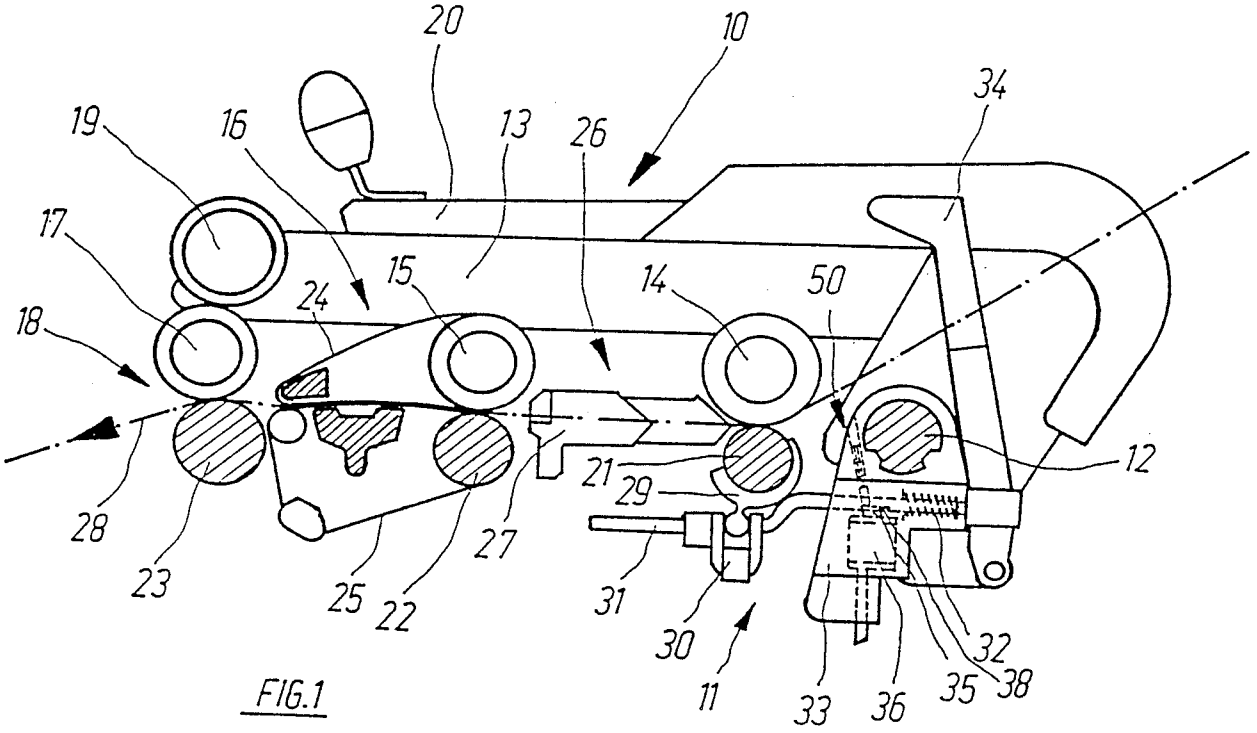
FIG. 1 is a side elevational view of a drafting device of a textile machine preferred embodiment of the stop motion apparatus of the present invention.

In FIG. 1–6, one preferred embodiment of the stop motion apparatus of the present invention is illustrated and is generally designated as 11. The stop motion apparatus 11 is adapted for use in the drafting device 10 of a textile machine. The drafting device 10 includes, in known manner, a roller support member 13, pivotally supported on a shaft 12 extending longitudinally along the machine, and supporting a top intake feed roller 14, a bottom intake feed roller 21, a top intermediate roller 15, a bottom intermediate roller 22, a top forward roller 17 and a bottom forward roller 23. The top forward roller 17 and bottom forward roller 23 form a forward roller assembly 18. The respective associated pairs of the intake feed rollers, the intermediate rollers and the forward rollers each define a nip therebetween for passage therethrough of a roving 28 fed to the drafting device 10.

The roller support member 13 additionally supports an intermediate roller drive assembly 16 which includes a top drive belt 24 for driving the top intermediate roller 15 and a bottom drive belt 25 for driving the bottom intermediate roller 22. The roller support member 13 also supports a clearer roller 19. The drafting device 10 additionally includes a conventional roving compressing device 27 mounted to the roller support member 13 in a draft zone 26 between the pairs of intake feed rollers and the intermediate rollers.

The stop motion apparatus 11 includes a stop member 29, an actuating rod 31, means connecting the stop member 29 to the actuating rod 31 such as, for example, a carriage 30, urging means such as, for example, a spring 32, and a notch engaging means. The actuating rod 31 is movably mounted in a frame such as, for example, a bearing housing 33 and the spring 32 is connected at one end to the bearing housing 33 and at its other end to the actuating rod 31. A spring tension adjusting lever 34 is pivotally mounted to the bearing housing 33 and operatively connected to the spring 32 for adjusting the tension of the spring.

Figures 2, 3, 4:
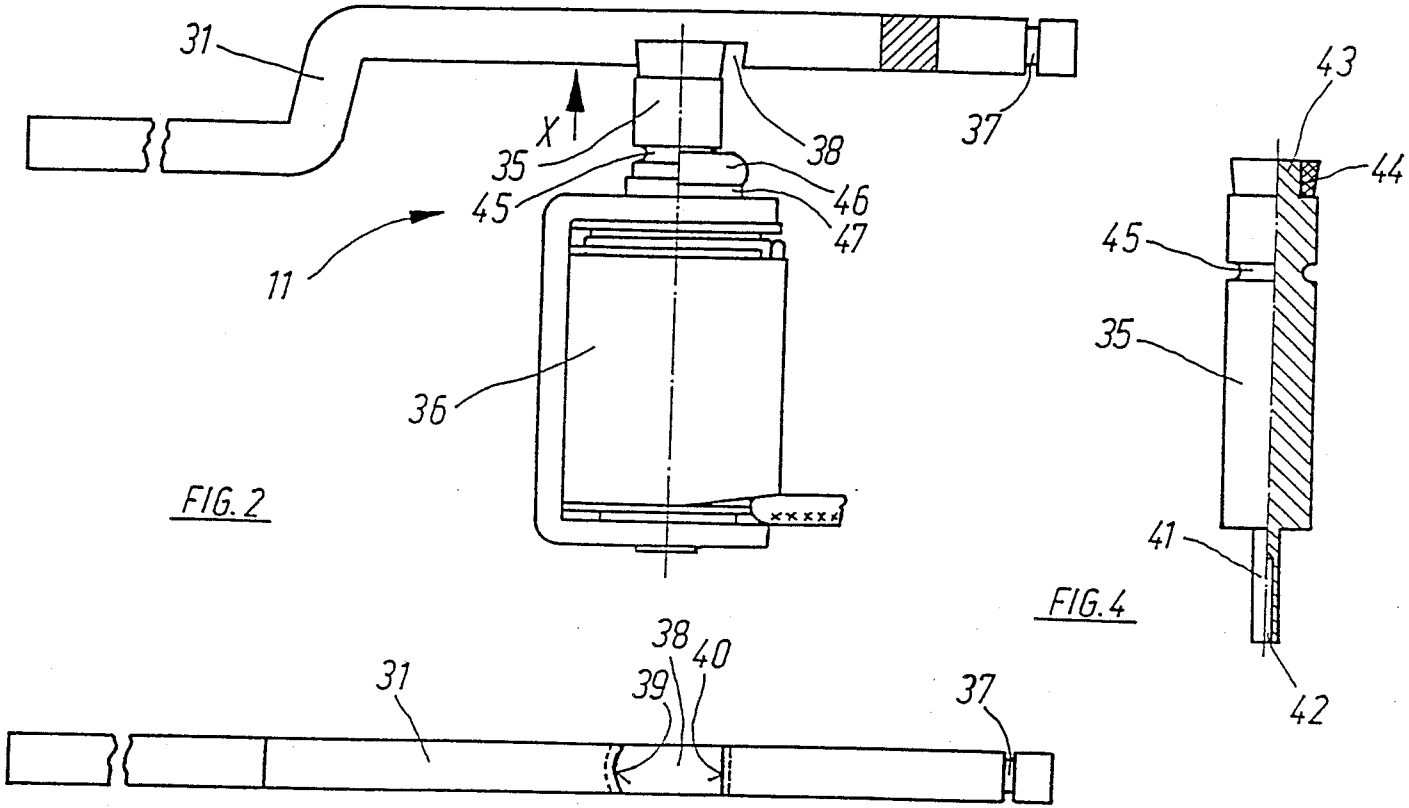
FIG. 2 is an enlarged side elevational view of a portion of the stop motion apparatus shown in FIG. 1, showing the notch engaging means and the means for selectively moving the plunger element of the stop motion apparatus in partial vertical section.
FIG. 3 is a bottom view of the actuating rod of the stop motion apparatus shown in FIG. 2.
FIG. 4 is a side elevational view, in partial vertical section, of the plunger element of the stop motion apparatus shown in FIG. 2.

As best seen in FIGS. 2 and 3, the actuating rod 31 is formed with an annular groove 37 adjacent one axial end thereof for receiving one end of the spring 32 therein. Additionally, the actuating rod 31 includes a notch 38 located approximately equidistant the annular groove 37 and the first bent portion thereof in the direction from the annular groove 37 to the carriage 30. The actuating rod 31 has a square cross-section and the notch 38 opens transversely to the longitudinal extent of the actuating rod 31 toward the bottom side of the rod.

The notch 38 includes an undercut surface 39 facing in the direction of urging the actuating rod 31 by the spring 32 and away from the stop member 29 and another undercut surface 40 facing in the direction opposite lthe urging by the spring 32. The undercut surface 39 is transversely arcuate and is arcuately concave. The other undercut surface 40 extends generally transversely to the longitudinal extent of the actuating rod 31. Accordingly, the undercut surfaces 39, 40 provide the notch 38 with a dovetail shape.

The notch engaging means of the stop motion apparatus 11 includes an electromagnet assembly 36 and a plunger element 35 supported therein for axial movement relative thereto in a vertical direction transverse to the actuating rod 31 and from below the rod. The electromagnet assembly 36 can be, for example, a solenoid. As best seen in FIGS. 2 and 4, the plunger element 35 includes a body portion, a cylindrical end portion 43 formed on the body portion of less cross-sectional area than the body portion and a sleeve portion 44 mounted on the end portion. Additionally, the plunger element 35 includes an annular groove 45 located generally at one-fourth the axial length of the plunger from the top of the end portion 43. A pin 41 of less cross-sectional area than the body portion of the plunger element 35 is formed at the other end of the body portion and includes an axial central bore 42 which is threaded for receiving one end of a spring (not shown) which biases the plunger element 35 to move in an axial direction outwardly from the electromagnetic assembly 36 in a conventional manner.

As best seen in FIG. 2, the plunger element 35 is configured for receipt in the actuating rod notch 38 for engagement with the undercut surface 39 in the disengaged position of the actuating rod 31 to prevent movement of the actuating rod from its disengaged to its engaged position by the spring 32. In this regard, the sleeve portion 44 of the plunger element 35 includes an annular inner surface having a diameter selected for permitting the sleeve portion 44 to be snugly mounted to the end portion 43 and an inverted frusto conical exterior surface tapering in the direction of the body portion. The frusto conical exterior surface of the sleeve portion 44 provides the sleeve portion 44 with an arcuately convex shape which is compatibly configured with the arcuately concave undercut notch surface 39.

The electromagnetic assembly 36 is operatively connected to a device such as, for example, a yarn break monitor which actuates the electromagnetic assembly to retract the plunger element 35 therein to thereby retract the plunger element 35 out of engagement with the notch 38 of the actuating rod 31. To minimize the undersirable entry of dirt, fluids and other contaminants into the interior of the electromagnetic assembly 36, the electromagnetic assembly 36 is provided with an annular resilient sealing ring 46 mounted to a shoulder portion 47 of the electromagnetic assembly 36, as best seen in FIG. 2. The annular resilient sealing ring 36 is adapted to selectively encircle the annular groove 45 of the plunger element 35 when the plunger element is retracted into the electromagnetic assembly 36.

The operation of the actuating rod 31 to move the stop member 29 into and out of engagement with the intake feed rollers is as follows. In its disengaged position, as shown in FIGS. 1 and 2, the actuating rod 31 is disposed such that the plunger element 35 is in engagement with the notch 38 of the actuating rod. In its disengaged position the actuating rod 31 is held against the urging of the spring 32 by the engagement of the undercut notch surface 39 with the sleeve portion 44 of the plunger element 35. The carriage 30, which movably connects the stop member 29 to the actuating rod 31 and is fixedly connected to the actuating rod 31, retains the stop member 29 out of engagement with the intake feed rollers in the disengaged position of the actuating rod 31.

When a conventional yarn break monitor or other device for actuating the electromagnetic assembly 36 detects an interruption in the feed of the roving 28 to the drafting device 10, the electromagnetic assembly 36 is energized to effecg movement of the actuating rod 31 from its disengaged position to its engaged position. Specifically, the energization of the electromagnetic assembly 36 causes the plunger element 35 to be moved axially inwardly into the electromagnetic assembly, whereby the plunger element is retracted from the notch 38. Once the sleeve portion 44 of the plunger element 35 clears the notch 38, the spring 32 automatically urges the actuating rod 31 to move to the right as shown in FIG. 1. The movement of the actuating rod 31 to its engaged position effects movement of the stop member 29 into roving stopping engagement with the intake feed rollers 14, 21.

To return the actuating rod 31 to its disengaged position from its engaged position, the rod is manually moved to the left with respect to FIG. 1 and the electromagnetic assembly 36 is deenergized to permit the plunger element 35 to be urged axially outwardly into engagement with the notch 38.

In FIGS. 5 and 6, one form of means 51 for manually clearing the plunger element 35 is illustrated in combination with the components described with respect to FIGS. 1–4. The manual clearing means 51 includes a shaft member 52 disposed in a bore in the bearing housing 33 above the plunger 51 and extending from its exterior surface to the actuating rod 31 and preferably formed of plastic. The shaft member 51 includes an enlarged cross-sectional area to portion 54, a body portion 52 of reduced cross-sectional area with respect to the top portion 54 and a forked end portion having a pair of tines 53 at the opposite end of the body portion 52. Additionally, the shaft member 51 includes a spring 55 mounted in encircling relation to the body portion 52 and extending between the top portion 54 and a shoulder formed in the bore in the bearing housing 33. The spring 55 biases the shaft member 51 to move in an axial direction away from the actuating rod 31.

As best seen in FIG. 6, the tines 53 of the forked end of the shaft member 51 are configured to straddle the actuating rod 31 and are movable relative thereto to engage the top of the sleeve portion 44 to the plunger 35. To this end, the sleeve portion 44 is configured to extend laterally beyond the actuating rod 31 to present an engagement surface for the ends of the tines 53.

To manually move the plunger element 35 into the electromagnetic assembly 36, the user depresses the top portion 54 of the shaft member 51 to move the tines 53 is straddling relation to the actuating rod 31 into contact with the sleeve portion 44 of the plunger element 35. The continued downward axial movement of the shaft member 51 causes the plunger element 35 to be pushed clear of the notch 38 of the actuating rod 31, thereby releasing the actuating rod to be moved from its disengaged to its engaged position under the action of the spring 32.

In FIGS. 7 and 8, another form of the manual clearing means 50 for manually clearing the plunger element 35 from the notch 38 is illustrated. In this form, the manual clearing means 50 includes an opening 56 formed in the bearing housing 33 at the side of the actuating rod 31 and plunger 35 and extending vertically from above the upward extent of the plunger to below the level of the actuating rod notch. This opening 56 permits access to the plunger element 35 for use of a tool, such as a screwdriver 57, to be inserted into the opening 56 to engage the lateral projection of the top of the sleeve portion 44 of the plunger element 35 to depress the plunger out of notch engagement and allow the spring 32 to retract the actuating rod 31 operation position to sop the feeding operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A stop motion apparatus for stopping the travel of roving through a nip defined by a pair of roving feed rollers of a drafting device of a textile machine, comprising:

a stop member for selective insertion into the nip to separate the roving feed rollers and press the roving against one of the feed rollers;

an actuating rod longitudinally movable for manipulating said stop member;

a frame movably supporting said actuating rod;

means connecting said stop member to said actuating rod;

urging means for urging said actuating rod from a disengaged position in whcih said stop member is held out of engagement with the roving feed rollers by said connecting means to an engaged position in which said stop member is disposed in the nip between the roving feed rollers;

said actuating rod having a notch formed therein, said notch opening transversely to the longitudinal extent of said actuating rod and having an undercut surface facing in the direction of urging by said urging means; and notch engaging means including a plunger element configured for receipt in said actuating rod notch against said undercut surface in the disengaged position of said actuating rot to prevent movement of said actuating rod from its disengaged to its engaged position by said urging means and means for selectively moving said plunger element into and out of said actuating rod notch.

2. A stop motion apparatus as claimed in claim 1 and characterized further in that said undercut notch surface is transversely arcuate.

3. A stop motion apparatus as claimed in claim 2 and characterized further in that said undercut notch surface is arcuately concave, and said plunger element is formed with an arcuately convex shape compatibly configured with said arcuately concave undercut notch surface.

4. A stop motion apparatus as claimed in claim 1 and characterized further in that said actuating rod notch includes another undercut surface facing in the direction opposite the urging by said urging means.

5. A stop motion apparatus as claimed in claim 4 and characterized further in that said another undercut surface extends generally transversely to the longitudinal extent of said actuating rod.

6. A stop motion apparatus as claimed in claim 5 and characterized further in that said undercut notch is in the form of a dovetail.

7. A stop motion apparatus as claimed in claim 1 and characterized further in that said plunger element includes a body portion, an end portion formed on said body portion and a sleeve portion, said end portion being of less cross-sectional area than said body portion and said sleeve portion being mounted on said end portion for engagement in the notch of said actuating rod.

8. A stop motion apparatus as claimed in claim 7 and characterized further in that said sleeve portion includes an annular inner surface and a frusto conical exterior surface tapering in the direction of said body portion.

9. A stop motion apparatus as claimed in claim 8 and characterized further in that said sleeve portion is formed of plastic.

10. A stop motion apparatus as claimed in claim 1 and characterized further in that said plunger element moving means includes a solenoid, said plunger element being movably axially supported in said solenoid for insertion into, and for retraction from, said actuating rod notch.

11. A stop motion apparatus as claimed in claim 10 and characterized further by an annular resilient sealing ring supported on said solenoid and in that said plunger element includes an annular groove, said annular resilient sealing ring selectively encircling said annular groove of said plunger element when said plunger element is retracted from said notch.

12. A stop motion apparatus as claimed in claim 1 and characterized further by means for manually clearing said plunger element from said notch and in that said plunger element extends laterally beyond said actuating rod for engagement during said manual clearing.

13. A stop motion apparatus as claimed in claim 12 and characterized further in that said manual clearing means includes a shaft member having a forked end mounted in said frame for axial movement toward said plunger element and a spring for biasing said shaft member away from said plunger element, said shaft member forked end being configured for straddling said actuating rod to engage said plunger element extending laterally beyond said actuating rod.

14. A stop motion apparatus as claimed in claim 13 and characterized further in that said shaft member is formed of plastic.

15. A stop motion apparatus as claimed in claim 14 and characterized further in that the other end of said shaft member has an enlarged cross-sectional area and said spring extends between said other end and said frame.

16. A stop motion apparatus as claimed in claim 12 and characterized further in that said manual clearing means includes an opening formed in said frame for permitting access to said plunger element.

* * * * *